United States Patent [19]

Sato et al.

[11] Patent Number: 4,641,081

[45] Date of Patent: Feb. 3, 1987

[54] SEMICONDUCTOR CIRCUIT OF MOS TRANSISTORS FOR GENERATION OF REFERENCE VOLTAGE

[75] Inventors: Ryoichi Sato, Kashiwa; Toshio Mimoto, Nara, both of Japan

[73] Assignee: Sharp Kabushiki Kaisha, Osaka, Japan

[21] Appl. No.: 706,529

[22] Filed: Feb. 28, 1985

[30] Foreign Application Priority Data

Feb. 28, 1984 [JP] Japan ..... 59-39146

[51] Int. Cl.[4] ..... G05F 3/16

[52] U.S. Cl. ..... 323/313; 323/314

[58] Field of Search ..... 323/312, 313, 314

[56] References Cited

FOREIGN PATENT DOCUMENTS

| | | | |
|---|---|---|---|
| 3138558 | 4/1983 | Fed. Rep. of Germany | 323/313 |
| 32362 | 3/1978 | Japan | 323/313 |
| 136649 | 11/1978 | Japan | 323/313 |

OTHER PUBLICATIONS

IBM Technical Disclosure Bulletin, vol. 23, No. 5, pp. 1840–1841, R. S. Becker, Oct. 1980.

IBM Technical Disclosure Bulletin, vol. 21, No. 2, pp. 727–728, B. H. Jensen, Jul. 1978.

*Primary Examiner*—Peter S. Wong

*Assistant Examiner*—Judson H. Jones

*Attorney, Agent, or Firm*—Birch, Stewart, Kolasch & Birch

[57] ABSTRACT

Semiconductor circuit of MOS transistors for generation of the desired reference voltage over a wide range with almost no dependence on the power voltage. An enhancement type MOS transistor and 1st depression type MOS transistor are connected in series across the power voltage, and a 2nd depression type MOS transistor and resistance component connected are in series across the power voltage. The above 1st depression type MOS transistor is connected to the gate of the 2nd depression type MOS transistor, and the reference voltage is derived from the connection point of the 2nd depression type MOS transistor and the resistance component.

8 Claims, 5 Drawing Figures

SEMICONDUCTOR CIRCUIT OF MOS TRANSISTORS FOR GENERATION OF REFERENCE VOLTAGE

BACKGROUND OF THE INVENTION

This invention relates to a semiconductor circuit for obtaining a constant voltage as a reference signal using MOS transistors.

Circuits in which a voltage level output by a sensor, or various other types of circuits, is compared with a standard reference voltage to in turn form various control signals are well known. There are various types of reference voltage generation circuits. In general, a power source voltage is divided with resistors R1 and R2 as shown in FIG. 4, and the reference voltage is output from the division point. In an alternative circuit, multiple depletion type (hereinafter abbreviated as D type) MOS transistors 1 are connected in series as substitute for the required resistance, with the reference voltage Vref taken out from an appropriate contact point. However, with the conventional circuit, since the reference voltage Vref is dependent on the power voltage Vcc, the reference voltage varies if the power voltage varies, making the circuit difficult to use.

OBJECT AND SUMMARY OF THE INVENTION

The object of this invention is to provide a circuit in which the defects in conventional circuits are eliminated, and the desired reference voltage can be obtained with almost no dependence on the power voltage over a wide range.

In order to achieve the above goal, the reference voltage generation circuit in this invention is provided with an enhancement type MOS transistor and 1st depression type MOS transistor connected in series across the power voltage, and a 2nd depletion type MOS transistor and resistance component connected in series also across the power voltage. The above 1st depression type MOS transistor is connected to the gate of the 2nd depletion type MOS transistor, and the reference voltage is derived from the connection point of the 2nd depletion type MOS transistor and the resistance component.

The circuit in this invention permits the output of a constant voltage with almost no dependence on the power voltage. Therefore, when this circuit is incorporated in an LSI, the functioning margin in relation to the power voltage is increased, making easier the circuit design of LSIs which are composed of MOS transistors. This invention can be applied to 256K Dynamic RAMs and other LSI circuits.

DETAILED DESCRIPTION OF THE INVENTION

Figure 1:
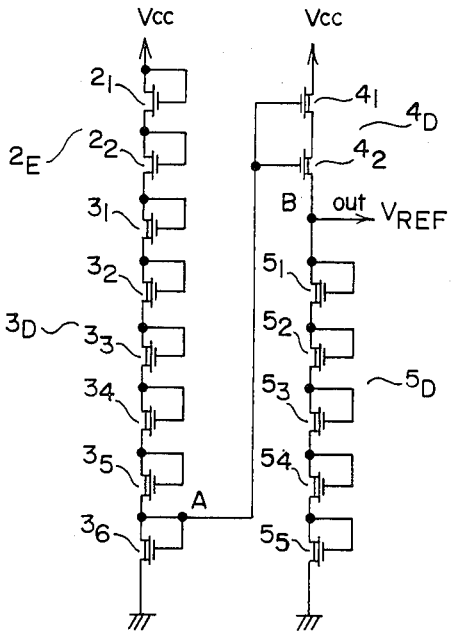
FIG. 1 shows a circuit with an embodiment of this invention.

FIG. 1 is a circuit diagram of an embodiment of this invention. It is composed of a 1st group of enhancement type (hereinafter abbreviated as E type) MOS transistors 2E, a 1st group of D type MOS transistors 3D, a 2nd group of D type MOS transistors 4D and a 3rd group of D type MOS transistors 5D. The above 1st group of E type MOS transistor comprises at least one (2 connected in series embodiment) enhancement type MOS transistors embodiment, with the gate and drain connected. The power source voltage Vcc is connected to one end of the drain, and the source side is connected to the next stage, the 1st group of D type MOS transistor 3D. The 1st group of D type MOS transistors 3D has at least one (6 in this embodiment connected in series) D type MOS transistors that have the gate and drain connected, with the above 1st E type MOS transistor 2E connected to the drain side, and the earth level to the source side. The point where the gate and drain of the MOS transistor $3_6$ are connected is point A, this transistor being on the earth level side of the 1st D type MOS transistor 3D. Gate $4_1$ and $4_2$ of the 2nd group of D type MOS transistor are connected to point A. The 2nd group of D type MOS transistor 4D has at least one D type MOS transistors (2 connected in series in this embodiment). One end of the drain side is connected to the power voltage Vcc, and the source side is connected to the 3rd group of D type MOS transistors 5D. The above 2nd D type MOS transistor 4D is connected to the above point A, which the gates of transistor $4_1$ and $4_2$ are connected to. The 3rd D type MOS transistor 5D has at least one (5 connected in series in this embodiment) D type MOS transistors. One side of the source side is connected to the source of the above 2nd D type MOS transistor 4D, and one end of the source side is connected to the earth level.

The reference voltage Vref, which is an output signal, is taken from the connection point B of the 2nd D type MOS transistor 4D and 3rd D type MOS transistor 5D.

The above 2nd D type MOS transistors 4D are mainly designed to function in the saturation range, serving as a constant current source. The 3rd D type MOS transistors 5D are designed to operate in the triode region in order to cause constant resistance operation.

In the above MOS transistor circuit, the reference voltage Vref is output from node B. When the MOS integrated circuited is used to generate the circuit board voltage from the power voltage with a charge pump, the absolute value of the circuit voltage increases as the power voltage increases with this kind of MOS integrated circuit. As a result of this, the threshold increases with the circuit board voltage, reducing the current that flows to node B. However, in the circuit in this embodiment, in order to adjust the above reduced current for a constant current flow, the 1st E type MOS transistor 2E and 1st D type MOS transistor 3D are connected in series to reduce the power voltage and rate of change, applying the output to the gate of the 2nd D type MOS transistor 4D. This enables the attainment of a constant reference voltage Vref, with a minimum of dependence on the power voltage.

Figure 2:
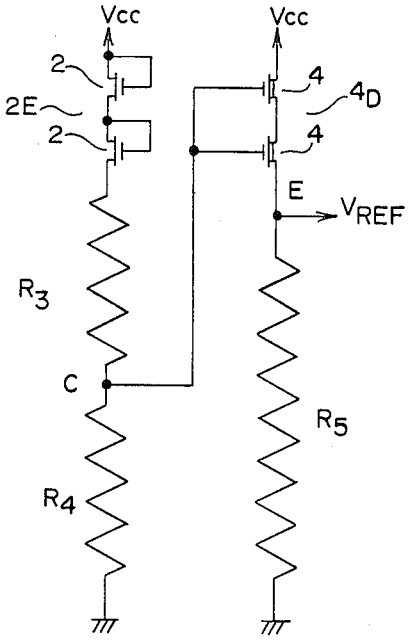
FIG. 2 and FIG. 3 are circuit diagrams with other embodiments of this invention.

Another embodiment of this invention is shown in FIG. 2. There is a 1st group of E type MOS transistors 2E and 2nd group of D type MOS transistors 4D. Resistors R3 and R4 are connected in between the source of the 1st E type MOS transistors and ground, and resistor R5 is connected in between the source of the 2nd D type MOS transistors 4D and ground. The connection point C of the above resistors R3 and R4, and the respective gates of the 2nd D type MOS transistor are connected together. In other words, in this embodiment, the 1st and 3rd groups of D type MOS transistors 3D and 5D in the previous embodiment shown in FIG. 1 have been replaced with resistors R3, R4 and R5, and the reference voltage Vref is produced as an output from node E with the same circuit operation.

Figure 3:
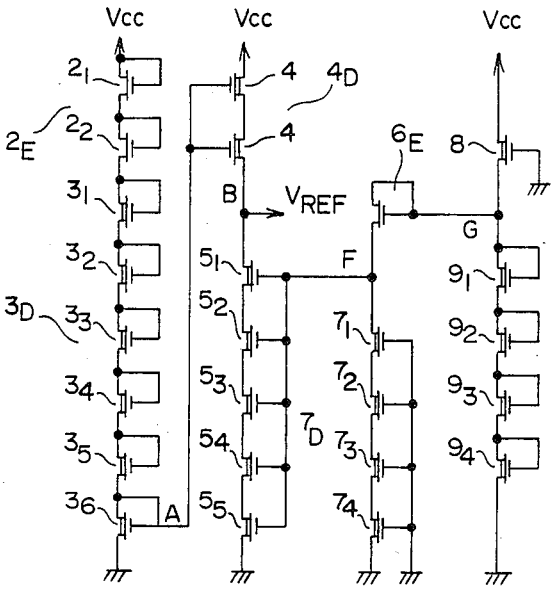
Figure 4:
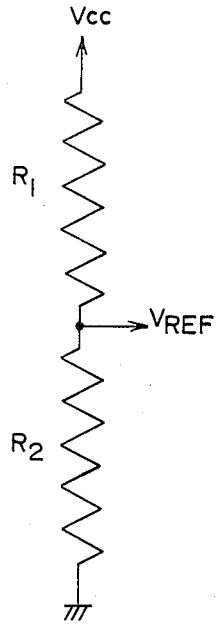
FIG. 4 PRIOR ART
FIG. 4 and FIG. 5 are circuit diagrams for conventional reference voltage circuits.
Figure 5:
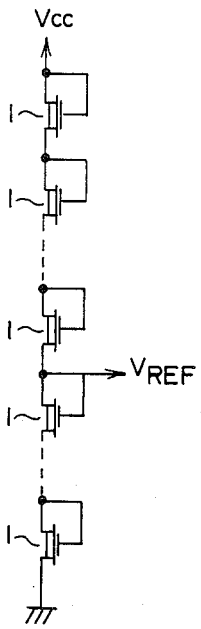
FIG. 5 PRIOR ART

FIG. 3 illustrates another embodiment of this invention. The adjusting circuit for a change in the threshold level of the 2nd group of D type MOS transistors 4D has the same composition as the one in the previous embodiment, but a circuit to eliminate the threshold level dependence of the E type MOS transistor on process fluctuation has been added. This circuit comprises a 2nd E type MOS transistor 6E, 4th group of D type MOS transistors 7D, 5th D type MOS transistor 8D and 6th group of D type MOS transistors 9D, which have the gate and drain connected. The 4th D type MOS transistor 7D has at least one (4 connected in series in this embodiment) D type MOS transistors, and the drain is connected to both the source of the above 2nd E type MOS transistor 6E, and to each gate of the above 3rd group of D type MOS transistors $5_1$–$5_5$. The gates of each transistor $7_1$–$7_4$ of the 4th D type MOS transistor 7D are commonly connected, with one end of the source side to the group level.

The drain and gate of the above 2nd E type MOS transistor 6E are connected to the connection point G of the 5th D type MOS transistor 8D and the 6th group of depletion type MOS transistors 9D. The drain of the 5th D type MOS transistor 8D is connected to the power source Vcc, and the gate is connected to ground. The 6th group of D type MOS transistors 9D has at least one (4 connected in series in this embodiment) depression type MOS transistors which have the drain and gate connected, and one end of the source side is connected to ground.

As shown in this embodiment, by connecting the 5th and 6th groups of D type MOS transistors 8D and 9D, a simple constant voltage circuit can be formed, and the voltage taken from node G can be reduced the same amount as the threshold level through the 2nd E type MOS transistor 6E, which is applied to the gate of the 3rd D type MOS transistor 5E. This offsets for the effect on the reference voltage Vref when the threshold level of the enhancement type MOS transistor changes due to process fluctuations, by changing the voltage applied to the gates of the 2nd and 3rd D type MOS transistors a corresponding amount in the same direction.

Furthermore, the threshold level of the 5th D type MOS transistor 8D changes according to changes in the power voltage as stated before, which also has an affect on the reference voltage Vref. However, by controlling the current that flows to node B with the 1st E type MOS transistor 2E and 1st D type MOS transistor 3D, this affect can be reduced to a sufficiently small value.

What is claimed is:

1. A circuit for producing a constant reference voltage, the reference voltage value being unaffected by variations in a related power source voltage, the circuit comprising:

a first set of enhancement type MOS transistors, the number of enhancement type MOS transistors being n, each one of said n transistors having a gate connected to a first active electrode, said n enhancement type MOS transistors being connected in series and having a first active electrode of a first one of said n enhancement type MOS transistors connected to the power source;

a first set of depletion type MOS transistors, the number of depletion type MOS transistors being m, each of said m transistors having a gate connected to a first active electrode, said m depletion type MOS transistors being connected in series, a first active electrode of a first one of said m transistors being connected to a second active electrode of the nth transistor of the series connection of said first set of enhancement type MOS transistors and a second active electrode of an mth transistor being connected to ground;

a second set of depletion type MOS transistors, the number of depletion type MOS transistors being x, gate electrodes of each of said x depletion type transistors being connected to a gate electrode of the mth transistor of the series connection of said first set of depletion type MOS transistors, said x transistors being connected in series and having a first active electrode of a first one of said x transistors being connected to the power source; and a resistance component connected between a second active electrode of the xth transistor of the series connection of said second set of depletion transistors and ground, wherein the constant reference voltage is a voltage appearing across said resistance component.

2. The circuit of claim 1 wherein said resistance component comprises a third set of depletion type MOS transistors, the number of transistors in this set being Y, each of the y transistors having a gate and a first active electrode, said gate and first active electrode being connected, said y transistors being connected in series, with a first one of said y transistors having a first active electrode connected to the second active electrode of the xth transistor of the series connection of said set of depletion transistors.

3. The circuit of claim 1 wherein $m \geqq 1$; $n \geqq 1$; and $x \geqq 1$.

4. The circuit of claim 1 wherein $N=2$.

5. The circuit of claim 1 wherein $x=2$.

6. The circuit of claim 2 wherein $m \geqq 1$; $n \geqq 1$; $x \geqq 1$; and $y \geqq 1$.

7. The circuit of claim 1 wherein said resistance component comprises:

a third set of depletion type MOS transistors, the number of transistors in this third set being y, gate electrodes of the y transistors being commonly connected, said y transistors being connected in series between said second active electrode of said xth electrode and ground.

8. The circuit of claim 11 further comprising:

a second set of enhancement type MOS transistors, said second set containing one transistor, said one enhancement type transistor having a gate electrode and a first active electrode commonly connected, a second active electrode of said one enhancement type transistor being connected to the commonly connected gates of said y transistors;

a fourth set of depletion type MOS transistors, said fourth set of transistors including a plurality of transistors connected in series and connected between said second active electrode of said transistor of said second set of enhancement type MOS transistors and ground, gate electrodes of said plurality of transistors being commonly connected to ground;

a fifth set of depletion type MOS transistors, the fifth set containing one depletion type MOS transistor, said one depletion type transistor having a gate connected to ground, a first active electrode connected to the power source and a second active electrode connected to a gate of said one enhancement type transistor of said second set of enhancement type MOS transistors; and a sixth set of depletion type MOS transistors, said sixth set including Z transistors, each of the z transistors having a gate connected to a first active electrode, the z transistors being connected in series between said second active electrode of said one depletion type MOS transistor of said fifth set of depletion type MOS transistors and ground.

* * * * *